US008978571B2

(12) United States Patent
Vaudore

(10) Patent No.: US 8,978,571 B2
(45) Date of Patent: Mar. 17, 2015

(54) BODY BOARD HAVING A HEAT ENGINE AND CAPABLE OF MOVING IN WAVES

(76) Inventor: Marc Vaudore, Puteaux (FR)

( * ) Notice: Subject to any disclaimer, the term of this patent is extended or adjusted under 35 U.S.C. 154(b) by 244 days.

(21) Appl. No.: 13/991,009

(22) PCT Filed: Nov. 10, 2011

(86) PCT No.: PCT/FR2011/052620

§ 371 (c)(1),
(2), (4) Date: May 31, 2013

(87) PCT Pub. No.: WO2012/085368

PCT Pub. Date: Jun. 28, 2012

(65) Prior Publication Data

US 2013/0239862 A1 Sep. 19, 2013

(30) Foreign Application Priority Data

Dec. 20, 2010 (FR) ..... 10 04972

(51) Int. Cl.

| | |
|---|---|
| ***B63C 11/46*** | (2006.01) |
| ***B63B 35/79*** | (2006.01) |
| ***A63B 35/12*** | (2006.01) |

(52) U.S. Cl.

CPC ..... *B63B 35/7943* (2013.01); *A63B 35/12* (2013.01)

USPC ..... 114/315

(58) Field of Classification Search

USPC ..... 114/315
IPC ..... A63B 35/12
See application file for complete search history.

(56) References Cited

U.S. PATENT DOCUMENTS

| | | | | |
|---|---|---|---|---|
| 3,890,920 | A * | 6/1975 | Buelk | 440/71 |
| 5,568,783 | A * | 10/1996 | Ditchfield | 114/242 |
| 7,004,099 | B2 * | 2/2006 | Iijima et al. | 114/315 |

FOREIGN PATENT DOCUMENTS

| | | | |
|---|---|---|---|
| DE | 20 52 402 | A1 | 4/1972 |
| DE | 20 2009 000167 | U1 | 4/2009 |
| EP | 1 977 968 | A1 | 10/2008 |
| FR | 2 617 793 | A1 | 1/1989 |
| GB | 2 270 282 | A | 3/1994 |
| JP | 2007203866 | A | 8/2007 |

OTHER PUBLICATIONS

International Search Report, dated Mar. 23, 2012, from corresponding PCT application.

* cited by examiner

*Primary Examiner* — Stephen Avila
(74) *Attorney, Agent, or Firm* — Young & Thompson

(57) ABSTRACT

A body board (1) has a heat engine (10) and an automatic starter (11), which is capable of moving in waves and remaining on the water when the engine is stopped, and onto which the user holds in order to be pulled along in the water in a body-drag position.

13 Claims, 2 Drawing Sheets

BODY BOARD HAVING A HEAT ENGINE AND CAPABLE OF MOVING IN WAVES

The present invention is a body board having a heat engine, capable of moving planning and in the waves.

Its function and features relate to pulling the user through the water, beyond the body board's hydroplaning speed, therefore planning, and to travel at a speed situated around 15 km/h in a body drag position. Thus the user can move in the waves, catch up with them and then overtake them, body boarding on his stomach, ensuring if possible that they do not break over the craft.

PRIOR ART

There are few solutions for light motorized nautical craft that do not fall within the definition of a boat (insufficient buoyancy to allow a person to stand, sit or lie on board).

HONDA (JP 2007203866) sells an underwater scooter having a heat engine which during travel, is therefore completely submerged below the water except for its snorkel: this is the heat-engine version of electric underwater scooters. This concept remains far removed from and incompatible with the necessary demands of the present invention, which are:

- the existence of a marine hull per se that must remain above the surface during travel,
- an electric starter, as opposed to a manual recoil starter, for rapidity and for the necessary engine range,
- a non-return system preventing water reaching the engine via the exhaust when the engine is stopped,
- and other equipment necessary for the planned planning regime and in the waves as described hereinafter.

CAYAGO (www.cayago.com), in an electric version, is another product with features that are more closely comparable: the company offers a personal electric water sled, performing on the surface with a speed of 15 to 20 km/h for 5 to 6 hp, and capable moreover of descending to a depth of 50 m, and therefore abandoning the flat form for a rocket shape suitable for the craft to dive. However, taking account of the electric batteries necessary for a diving regime and for the high performance levels delivered, the product weighs 60 kg, for a range that remains limited to one hour of use, in addition to the fairly dissuasive cost of these technologies.

GB patent No. GB2270282 presents generally a body board having a heat engine. Nevertheless, four significant points for the viability of the craft, its benefit and its extension to a regime of use at speed and in waves, have to date not been identified or resolved:

- since the heat engines as well as the exhaust are situated below the waterline, as soon as the device is intended to be capable of stopping and remaining immobile in possibly rough water, the problem arises of water inevitably reaching the engine via the exhaust, once the combustion gases present in the exhaust have cooled and contracted. Since the exhaust is very short, i.e. only a few centimetres, with gases that are consequently even hotter and might contain two-stroke engine oil (2 to 3% mix), the craft must have a system to counter or block water reaching the engine that is not significantly affected over time by high temperatures and oil, and is maintenance-free.
- in order to encompass a regime of speed planning and in the waves, a craft of this nature, which is slowed by the significant turbulence produced by the user's body in the water, requires a mechanical thrust that is available from an engine power of the order of 5 hp or more. An engine with such power cannot reasonably be started by just anyone with a manual recoil starter, especially in the sea without a firm footing on the ground. The waste of human energy would jeopardize the safety of the user: cramp, rapid fatigue, the approach of a large wave, etc. with a very low likelihood of starting on the first try. As the invention relates here to a regime of speed and in the waves, it therefore requires that the invention be mandatorily equipped with an automatic starter (electric motor starter)
- in order to access a regime of travelling in the waves with the inherent risks of capsize and of waves breaking over the craft, the craft must be provided with a device for automatically closing the air intake via the snorkel, triggered manually or using a sensor
- Finally, to keep the engine idling once started when no movement is required, a clutch device can be useful.

There is therefore currently no invention providing solutions to the aforementioned needs and key points.

Conventional body boarding is recognized and included among the sports with international competition circuits. Motorized body boarding is an activity and an invention that does not yet exist:

- it invents a novel motorized, ultra-light nautical leisure activity
- it could one day be a motorized sport with its own competition circuit, in a similar way to the success achieved by jet skiing
- it could be useful to equip teams monitoring beaches that are dangerous for bathing
- it could be used without a certificate of competence to tow surfers or kitesurfers
- it also provides a rapid and enjoyable form of roaming in the sea, lakes or rivers, etc.

The technical invention that it requires is also quite specific in the arrangement of the constituent elements and on-board devices.

THE INVENTION

The user therefore lies face down in the water, holding onto the craft using handholds, which can be handles or other elements situated on the top of the upper portion of the body board, called the hull. A portion of the hull remains above the surface both when stationary and during travel. The shape and material of the hull can vary (body board, small boogie board, as non-limitative examples): any nautical hull that gives the user buoyancy and which is nevertheless insufficient to allow an 80 kg user to adopt a standing position when travelling, and also insufficient to allow the craft to float out of the water with an 80-kg user lying on the craft. Thus, the craft is commonly treated in law not as a boat, but a water sled. The craft is less than 2 metres in length. The user rests his forearms and optionally part of his chest on the hull, with his legs trailing in the water behind the craft, because it is steered by pulling on one or other of his arms in order to change the direction of travel, with the legs acting as rudder. The user accelerates and decelerates using a throttle control.

For reasons of acoustic optimization, stability and cooling, all or part of the engine is located below the waterline of the craft.

The propulsion element of the craft is therefore situated underneath the hull or incorporated therein, depending on the manufactured thickness thereof. It may beneficial for the propulsion unit to be situated at a distance of a few centimetres (at least 2 cm) below the planning bottom of the hull, in order to avoid altering the water flows on which the bottom rests and rebounds in the travelling phase. In this case, the propulsion unit can be connected to the body board by rigid profiled connecting elements or struts.

Due to its intended purpose, it is also necessary for the craft to be re-started rapidly between two waves, and in the water, where the user is not necessarily touching bottom, and therefore electrically. An electric starter also makes it possible to access engine power ranges from 5 to 7 hp, here required by the craft for the speed envisaged.

The craft must also have on board a system for clearing possible infiltrations of water via the air intake to the carburettor of the engine, in the waves regime where splashes of water can often occur, and through the exhaust, due to the turbulent movements.

The engine can be fitted with a clutch of a centrifugal or other type between the propeller and the drive shaft to allow idling, so that the craft can remain stationary while the engine is still running For reasons of auditory and olfactory nuisance, the outlet of the exhaust pipe for the engine combustion gases is below the waterline of the craft when it is placed in the water.

Moreover, the user must be able to leave the craft in the water for long periods with the engine off, then return to it at this location and re-start it. The craft must therefore have on board a system for preventing any damaging entry of seawater to the engine, due to the contraction of the combustion gases (600-700°) during cooling, as well as the outward escape of the gases. In fact, the circuit travelled by the gasoline-air mix of a 2-stroke engine is not very leak tight in the reverse direction towards the snorkel. The solution provides for the use of an electric micro air pump that periodically blows air into the exhaust, and/or a manually or automatically switched valve.

In the event of the user falling off out of reach of his craft, a device can be provided for the dual safety of the user and of the machine:

- detecting that the user has fallen off, by the release of a trigger on the handle, a safety lanyard being pulled away, or other sensor
- automatic blocking of the air intake supplying the engine, by releasing a valve, immediately stopping the craft.

Finally, for reasons of air transportation, or for using the body board on its own in the conventional manner without an engine, provision can be made for the engine part to be separated quickly and easily from the body board part, by means of elements connecting the propulsion unit to the hull.

An ultra-light weight of around 10 kg is envisaged for the craft, allowing the craft to be comfortably carried in a backpack.

Figure 1:
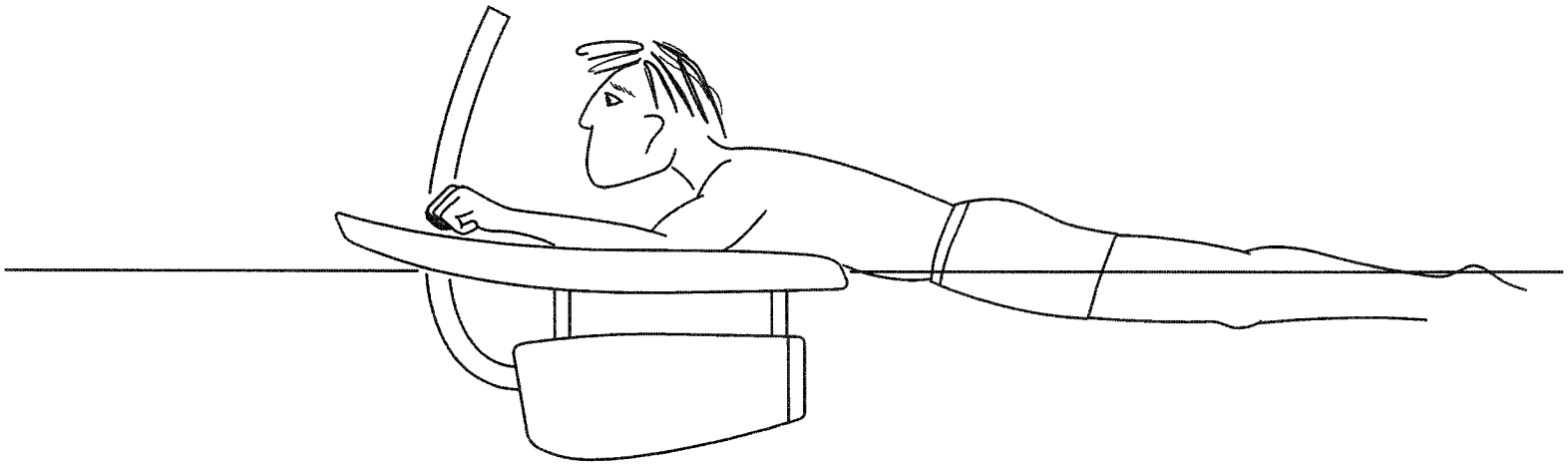
FIG. 1 depicts a user on a body board.
Figure 2:
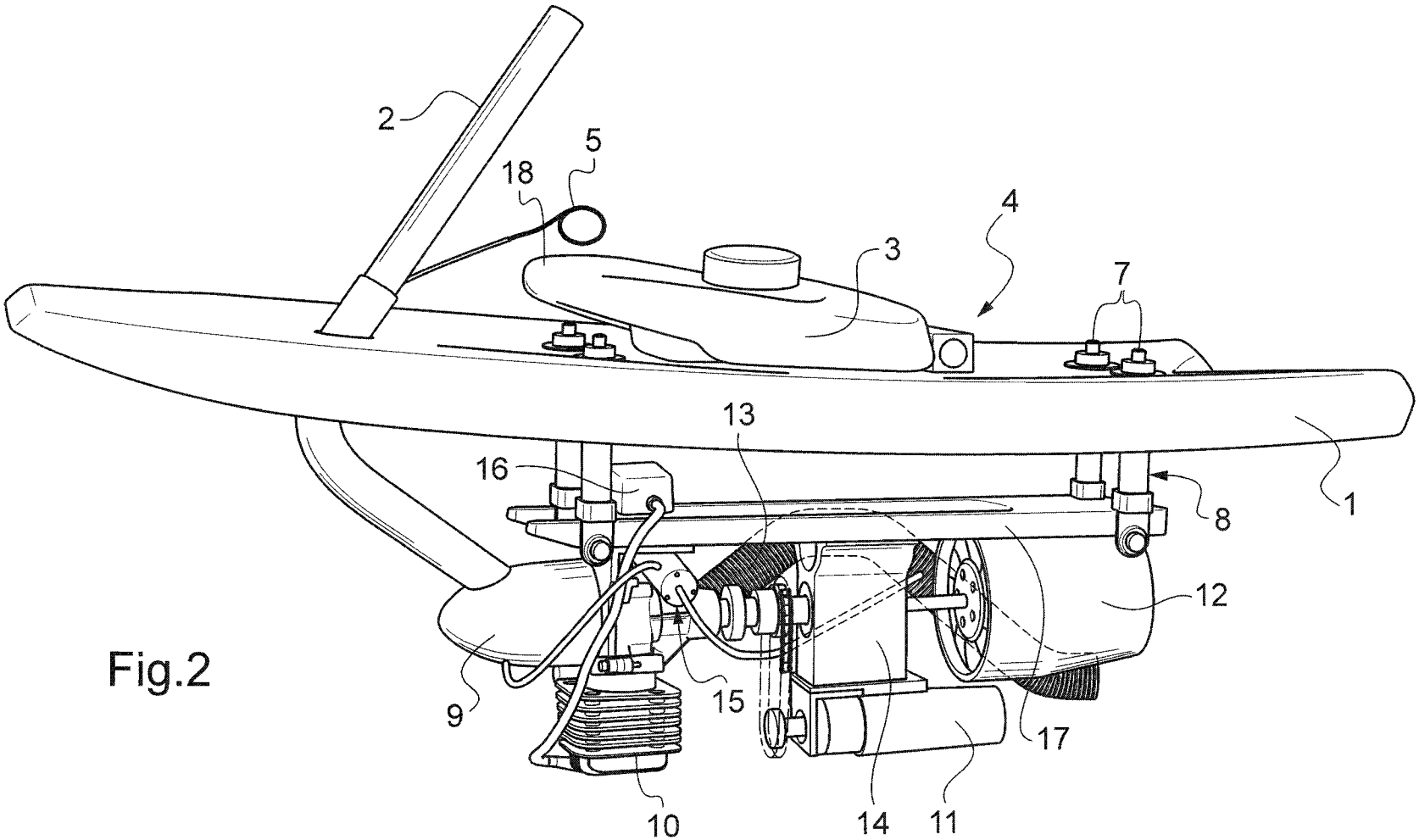
FIG. 2 depicts an embodiment of the invention in detail.

Embodiment:

The embodiment given by way of example consists of 2 parts: the propulsion unit and the hull.

The 2 parts are a few centimetres apart and connected by a few connecting elements (8) or struts.

The attached diagram shows an illustration of an embodiment based on a body board, but this is merely a simple example implementation in the form of a boogie board. It describes the assembly principle of the craft, without its outer hull or handles, and with a fuel tank that is not incorporated.

The surface part comprises:

- a hull having a planning bottom (1) here 1.20 metres long, which is planar overall, but which can have devices that increase its planning or steering ability: a slightly V-shaped section, tunnels, recesses, etc. or a slightly spatulate shape at the front to improve its passage through the waves
- the planning bottom is made of material that is sufficiently light and rigid for the mechanical properties sought. The bottom is not translucent and does not lend itself to any purpose other than that described; it does not enable the craft to be used to view the surroundings underwater
- a snorkel (2) conveying surface air to the sealed air chamber (9) isolating the carburettor from the seawater. A wide snorkel optionally allows the throttle control (5), fuel pipe and power supply cables to pass through to the propulsion unit
- optionally, a valve in the air intake of the engine, which is switched to the closed position when it is detected that the user has fallen off: by the release of a trigger, a safety lanyard being pulled away, or another sensor, the engine is then stopped
- the inserts of the struts (7) in the body board: by gripping the rigid foam of the body board by wide washers on each side, or inserts embedded in the resin, based on a small boogie board made of more rigid material
- a 2- or 3-litre gasoline tank (3), ideally moulded in the portion above the surface. The tank can be provided with baffles to damp the movements of the gasoline due to travel
- a battery pack (4) supplying the electronic ignition of the gasoline engine (10), the starter (11) and the micro-pump (15), and the electronic or electromechanical systems controlling the valve and the micro-pump
- a few associated control functions close to the handles, in particular:
  - a circuit-breaker signalling that the user has fallen off
  - a push-button for engaging the starter and for stopping an engine accelerator trigger
  - it is possible to have a system for anchoring a harness worn by the user, at the rear of the body board, for high speeds that pull on the arms for too long. The activity can prove to be physically demanding due to the repeated changes in direction and speed undertaken.

The propulsion unit comprises:

- an assembly frame (17) for the different elements and the outer hull
- a self-disengaging electric starter (11)
- a light, high-performance heat engine (10)
- an exhaust pipe (13) angled downwards at its outlet (air trap) and discharging the combustion gases, at the level of the powerful water flow from the water jet, in fine bubbles, thus reducing the noise generated and several metres behind the user
- optionally, a clutch to facilitate the work of the starter initially, and subsequently to make it possible to leave the craft immobile while keeping the engine idling
- a water jet system (12) constituted by a propeller housed in a tube, as in a jet ski,
- a system to prevent seawater returning to the engine through the exhaust pipe; here a micro air pump (15) is chosen, blowing air into the exhaust, and capable of operating when the craft is under way or also when it is stationary on a mooring.
- a system for draining infiltrations of water from the engine air intake at the level of the snorkel or the base of the sealed air chamber of the carburettor, which can be constituted by the same electric micro-pump, here drawing the air and sometimes the water that has infiltrated, discharging everything into the exhaust.

an outer hull suitable for the propulsion unit (here removed in the figure), fixed thereto, and which does not encompass the entire board, so as not to reduce the area of the bottom suitable for planning It has openings for directing the water flows towards the engine housing for cooling purposes, and towards the water jet system, for the purposes of propulsion.

an ignition, preferably electronic (16), supplies the spark plug of the engine the frame (17) supports the assembly of the mechanical elements and transmits the thrust to the body board, using the 4 connecting elements (8). The frame is here constituted by 2 side rails made of carbon profiles joined by assembly, having a cross section 20×10 mm and a length of 50 cm.

the propeller shaft will be centred over its length by the ball bearings and a bearing flange, housed in a tower (14). The axial thrust created by the water jet propulsion is transmitted to the frame by the tower, which is itself firmly secured to the frame with screws. The gasoline engine thus does not have to withstand significant axial force.

Precautions are necessary for the underwater running of a gasoline engine which is not naturally intended to operate in this element. Here are the particular features to be provided around the propulsion system in order to make this technically bold choice viable:

the water tightness of the drive shaft outlet is promoted by the choice of a 2-stroke, rather than a 4-stroke engine: in the case of a 2-stroke engine, the water tightness is provided natively by sealed ball bearings, taking account of the low and high pressures of the air-gasoline-oil gas mix flowing in the crankcase, before being injected towards the cylinder. Optionally, this water tightness can be doubled by a greased lip seal.

the electric starter will be ideally in the engine housing; otherwise it must be adapted to the constraints of the underwater environment due to the existence of mobile components.

the components are preferably made from composite materials so that they are not greatly affected by corrosion problems the surfaces of the metal components can be protected by the usual anticorrosion techniques: anodization, surface treatment, zinc or magnesium sacrificial anode, surface coating, resin casting, etc. Marine corrosion is however not as great as in the ports that have a high presence of metal masses: in the present case of envisaged use, intermittent immersion and daily rinsing, added to the other aforementioned precautions, are sufficient to limit corrosion significantly The main weight points are located in the following elements:

the heat engine will weigh 2 kg, for 5 to 7 hp the electric starter will unfortunately weigh approximately 1 kg the battery will weigh 0.5 to 1 kg the addition of a compact centrifugal clutch that has been made watertight, similar in size to those in some rotary garden lawnmowers, will add 0.5 kg It is therefore possible to produce the invention for a total dry weight (excluding fuel) of less than 10 k g, body board included, like the assembly shown in the attached diagram. Depending on the rotation speed of the engine used, and to minimize the cavitations effects in the turbulent water flow, it will be necessary to adopt a satisfactory combination of the elements affecting the load and efficiency of the engine: the pitch of the propeller and the propeller surface, the adoption of propeller anti-cavitations cones in front of and behind the propeller, and in the worst case, possibly a reduction gearbox on the propeller shaft.

The user places his water sled in the water, engages the main power switch, holds onto the craft and pushes the push-button of the electric starter to start the heat engine. He then adjusts its speed using the manual throttle control.

The invention claimed is:

1. A body board having a heat engine, performing the function of towing a user through the water, the body board comprising:

a hull providing buoyancy, said hull being a body board (1) or boogie board, or any marine hull, said hull remaining partially above the surface in a travelling phase, said hull having a small size, such that said hull does not provide sufficient buoyancy to allow an adult user a travelling position standing thereon and said hull does not float with an adult user lying thereon out of the water, said hull having a throttle control (5), said hull having hand-holds (18) situated on an upper side of the hull, and a propulsion unit situated underneath the hull or in the hull, said propulsion unit containing a heat engine (10) situated at least partially below the waterline of the body board and supplied with air via a snorkel (2), said propulsion unit containing an electric starter (11), a propeller/tube system (12), and an exhaust pipe (13) capable of discharging the combustion gases and having an outlet below the surface of the water, the exhaust pipe being equipped with a water non-return system, preventing water reaching the engine via the exhaust pipe, when the engine is stopped, wherein the water non-return system comprises an electric micro air pump (15), opposing said water entry.

2. The body board according to claim 1, wherein the water non-return system comprises a valve closing the exhaust pipe, operated manually or automatically.

3. The body board according to claim 1, further comprising:

a sensor detecting that the user has fallen off:

by the release of a trigger, a safety lanyard being pulled away, or other; and a mechanism automatically closing the snorkel, activated in the event of the user falling off.

4. The body board according to claim 1, equipped with a clutch allowing the propeller to be immobile without stopping the engine.

5. The body board according to claim 4, equipped with a centrifugal clutch.

6. The body board according to claim 1, wherein the propulsion unit is underneath the hull, separated by at least 2 centimetres from the face of the hull which is in contact with the water and attached to the hull by connecting elements, the connecting elements being optionally removable to allow the hull to be separated from the propulsion unit.

7. The body board according to claim 1, wherein, the hull has a planning bottom, the hull is not translucent, such that it does not enable the craft to be used to view the surroundings underwater, and the handholds are handles.

8. A body board having a heat engine, performing the function of towing a user through the water, the body board comprising:

a hull providing buoyancy, said hull being a body board (1) or boogie board, or any marine hull, said hull remaining partially above the surface in a travelling phase, said hull having a small size, such that said hull does not provide sufficient buoyancy to allow an adult user a travelling position standing thereon and does not float with an adult user lying thereon out of the water, said hull having a throttle control (5), said hull having hand-holds (18), situated on the upper side of the hull, a propulsion unit situated underneath the hull or in the hull, said propulsion unit containing a heat engine (10) situated at least partially below the waterline of the body board and supplied with air via a snorkel (2), said propulsion unit containing an electric starter (11), a propeller/tube system (12), and an exhaust pipe (13) capable of discharging the combustion gases and having an outlet below the surface of the water, the exhaust pipe being equipped with a water non-return system, preventing water reaching the engine via the exhaust pipe, when the engine is stopped, a sensor detecting that the user has fallen off: by the release of a trigger, a safety lanyard being pulled away, or other, and a mechanism automatically closing the snorkel, activated in the event of the user falling off.

9. The body board according to claim 8, wherein the water non-return system comprises a valve closing the exhaust pipe, operated manually or automatically.

10. The body board according to claim 8, equipped with a clutch allowing the propeller to be immobile without stopping the engine.

11. The body board according to claim 10, equipped with a centrifugal clutch.

12. The body board according to claim 8, wherein, the propulsion unit is underneath the hull, separated by at least 2 centimeters from the face of the hull which is in contact with the water, and the propulsion unit is attached to the hull by connecting elements, the connecting elements being optionally removable to allow the hull to be separated from the propulsion unit.

13. The body board according to claim 8, wherein, the hull has a planning bottom, the hull is not translucent, such that the hull does not enable the craft to be used to view the surroundings underwater, and the handholds are handles.

* * * * *